United States Patent [19]

Flanner

[11] Patent Number: 4,949,871

[45] Date of Patent: Aug. 21, 1990

[54] BARRIER PACK PRODUCT DISPENSING CANS

[75] Inventor: Lloyd Flanner, Hudson, Ohio

[73] Assignee: Aerosol Systems, Inc., Macedonia, Ohio

[21] Appl. No.: 308,899

[22] Filed: Feb. 9, 1989

[51] Int. Cl.[5] ..... B65D 35/24; B65D 83/14

[52] U.S. Cl. ..... 222/95; 222/386.5

[58] Field of Search ..... 222/95, 386.5, 105

[56] References Cited

U.S. PATENT DOCUMENTS

| | | | |
|---|---|---|---|
| 3,471,059 | 10/1969 | Moller et al. | 222/95 |
| 3,540,623 | 11/1970 | Wittke | 222/95 |
| 3,986,641 | 10/1976 | Carey | 222/95 |
| 4,095,724 | 6/1978 | Perusco | 222/95 |

FOREIGN PATENT DOCUMENTS

| | | | |
|---|---|---|---|
| 0178573 | 4/1986 | European Pat. Off. | 222/95 |
| 2043179 | 10/1980 | United Kingdom | 222/95 |

*Primary Examiner*—H. Grant Skaggs

*Attorney, Agent, or Firm*—Oldham & Oldman Co.

[57] ABSTRACT

A product bag for a barrier pack product-dispensing can includes a hollow receptacle comprising a cylindrical middle section with frustum-shaped sections connected to the top and bottom thereof. The lower, closed narrower end of the bottom section has a tubular projection attached thereto and extending downwardly therefrom the supporting the bag on the bottom of the barrier pack can, while the narrower upper end of the top section is adjoined by a hollow cylindrical section for connecting the bag to the top of the can. A barrier pack can incorporating the product bag is also described.

15 Claims, 2 Drawing Sheets

BARRIER PACK PRODUCT DISPENSING CANS

TECHANICAL FIELD

This invention relates to pressurized product dispensing containers. More particularly, this invention relates to collapsible receptacles or product "bags" useful as product containers for barrier pack dispensing cans. Specifically, this invention relates to pressure-deformable product bags for barrier pack cans shaped to facilitate collapse in a configuration that assures expulsion of substantially all of the product contents therefrom.

BACKGROUND OF THE INVENTION

Containers utilizing propellants to discharge their contents have enjoyed widespread popularity over the years since they are extremely compact and portable, inexpensive and simple to operate, and capable of serving as product storage containers when not in use. Such pressurized product containers include both those of the aerosol-type, in which the propellant and product are mixed before being expelled through the container's discharge valve in atomized form, and the so-called "barrier pack" canisters or cans, in which the product is contained in a collapsible inner product bag packaged inside an outer can, with a pressure generating propellant disposed between the two. When the barrier pack discharge valve, which is connected to the inner bag, is opened, the packaged product is discharged through the valve, as a result of the pressure from the propellant acting against the outside of the inner bag, resulting in the latter's compression.

In instances where the entrainment of propellant in the product to be dispensed must be avoided, the barrier pack has distinct advantages over the aerosol containers, due to the isolation of the propellant from the product. A further advantage is to be found in the fact that the propellant is prevented from escaping to the atmosphere during discharge of the product, thus avoiding potential safety hazards, as well as environmental problems.

A variety of inner containers have been proposed for barrier packs, for example, a pleated bellows-like container that collapses along its longitudinal axis, forcing the product through an opened discharge valve. A drawback of the container, however, is its tendency to trap air in the extremities of the bellow folds during the product filling operation, particularly evident in the case of viscous products. With time, the trapped air migrates throughout the interior of the container in the form of bubbles which contaminate the product. As suggested this can be undesirable, for example, in the case of room temperature vulcanizing silicone products intended for the formation of gasketing material. The entrapped air tends to destroy the sealing integrity of gaskets formed from such product, making the container unsuitable for the application.

Another approach proposed involves the use of the so-called piston-type barrier pack can in which a movable partition disposed transversely across the can's cross-sectional area provides a barrier between the product in the upper part of the can, and the propellant located in the bottom thereof. When the discharge valve is open, the propellant forces the partition upwardly in the can, resulting in the expulsion of product through the valve. Unfortunately, while effectively isolating the propellant from the product, injury to the can, for example dents therein, interfere with movement of the partition, disabling the discharge process.

Still another solution proposed has involvd the use of a flat-bottomed, cylindrically-shaped inner container formed from thin-walled plastic that is inserted in the outer pressure can by forcing it through the relatively constricted upper opening in the can's top. The inner container is thereafter collapsed by the propellant's pressure when the valve attached to the container is opened, resulting in the discharge of the container's contents. However, the process of forcing the container through the constricted opening results in permanent indentation of the inner container, producing distortions which are permanently set into the walls of the container that prevent its proper filling. Furthermore, the flattened bottom of the inner container can act in a fashion similar to that of a reinforcing element. This interferes with the total collapse of the container, trapping product therein which becomes unusable as a consequence. In addition, the right angle interface of the container's flat bottom with its vertical walls has a tendency to retain air adjacent thereto during the filling process, again resulting in the undesirable contamination previously described.

A somewhat different approach, but like that involving the plastic flat-bottomed cylindrical container, makes use of a similarly shaped container which, however, is fabricated from thin walled aluminum, rather than plastic. While such a container avoids permanently set indentations, and tends to collapse more completely than the plastic container described, it still suffers from a tendency to trap air at the junction of the container's flat-bottom and its wall, again resulting in undesirable air contamination of the product. In addition, the manufacture of thin-walled aluminum containers requires relatively complex machinery, and the containers are expensive to fabricate.

DISCLOSURE OF THE INVENTION

In view of the preceding, therefore, it is a first aspect of this invention to provide an improved barrier pack can.

A second aspect of this invention is to provide an inner container, or product bag for a barrier pack can that is configured in a shape that collapses readily and substantially completely.

An additional aspect of this invention is the provision of a product bag for a barrier pack can that may include a support member, or foot, on the bottom thereof, which supports and properly orients the bag during the filling operation.

Another aspect of this invention is to provide a barrier pack can that is capable of dispensing product without entrained air bubbles therein.

Yet another aspect of this invention is to furnish a product bag for a barrier pack can that is protected from puncture during the pressurizing process.

A further aspect of this invention is the provision of a product bag for a barrier pack that minimizes the amount of contained product unavailable for dispensing.

A still further aspect of this invention is to provide a product bag for a barrier pack can that is easy to insert in the can and to fill with product without entrapping air therein.

Another aspect of this invention is to provide a product bag that is expensive to fabricate.

The foregoing and other aspects of this invention are provided by a unitary collapsible bag for storing product in a barrier pack product-dispensing can comprising:

an upper section;

a middle section; and a lower section, said middle section having an open-ended, cylindrical shape, while said upper and lower sections are frustum-shaped, the upper section being open-ended, and the lower section having an open larger end and a closed smaller end, the larger ends of said upper and lower sections adjoining respective ends of said middle section, wherein connection means are provided at the smaller end of said upper section for attaching said receptacle to the top of said can, interior thereof, while receptacle support means are attached to the smaller, closed end of said lower section for supporting said receptacle on the bottom of said can.

The foregoing and additional aspects of the invention are provided by a product-dispensing barrier pack can comprising:

a unitary collapsible bag as defined in the preceding paragraph;

a can;

a discharge valve;

a product to be dispensed; and a propellant said can being enclosed except for an opening in the top thereof adapted to receive said discharge valve which is connected thereto, said bag being disposed inside said can with the interior of said bag in communication with said valve, and when said valve is opened, through said valve to the atmosphere outside said can, said bag being filled with said product to be dispersed, and said propellant being located in the space between said can and said bag.

The foregoing and further aspects of the invention are provided by a product-dispersing barrier pack can comprising:

a unitary collapsible bag;

a can;

a discharge valve;

a product to be dispersed; and a propellant, wherein said bag, which is disposed inside said can, comprises an upper section, a middle section, and a lower section, said middle section having an open-ended cylindrical shape, while said upper and lower sections are frustum-shaped, the upper section being open-ended, and the lower section having an open larger end and a closed smaller end, the layer ends of said upper and lower sections adjoining respective ends of said middle section, and wherein said can is enclosed except for an opening in the top thereof adapted to receive said discharge valve which is connected thereto, said upper section also being connected to said opening by means of an open-ended hollow cylinder one end of which adjoins the smaller end of said upper section, while the other end of which is attached to said opening, the interior of said bag thereby being in communication with the atmosphere outside said can when said valve is open, and wherein further, said bag has a tubular projection attached thereto at the smaller end of said lower section, said projection extending from said lower section to the bottom of said can.

BRIEF DESCRIPTION OF THE DRAWINGS

The invention will be better understood when reference is had to the following drawings, in which like-numbers refer to like-parts, and in which.

DETAILED DESCRIPTION OF THE INVENTION

Figure 1:
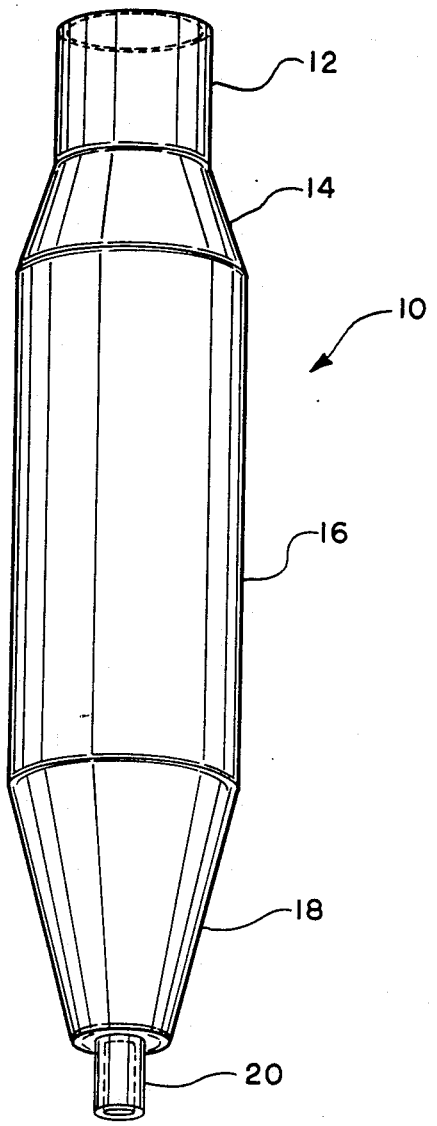
FIG. 1 is an isometric view of a product bag of the invention.

FIG. 1 is an isometric view of a product bag of the invention, generally 10. As shown, the bag 10 comprises a hollow receptacle comprising an open-ended, cylindrically-shaped middle section 16, the upper end of which adjoins the larger end of an open-ended frustum-shaped upper section 14. The lower end of the middle section 16 adjoins the larger open end of a frustum-shaped lower section 18. The lower section 18 has a closed lower end to which is attached a tubular projection or "foot" 20, while the smaller end of the upper section 14 adjoins an open-ended cylinder 12, the latter attaching the bag to the can within which it is contained by being flanged or flared over the top of the can, as better shown in FIG. 3.

The shape of the lower frustum-shaped section 18, more particularly the angle defined by the frustum wall along the frustum's longitudinal axis, and a plane intersecting said axis at right angles thereto, will depend upon a number of considerations, and may be varied within fairly broad limits. For example, factors which will influence the magnitude of the angle include such considerations as bag fabrication requirements, since it is desirable to provide an angle which will facilitate manufacture of the bags by existing molding techniques. In addition, the angle selected will be such that it promotes ease of filling, without the inadvertent entrapment of air within the bag. Of special importance is a need to provide an angle which will assist in the ease and uniformity of bag collapse during the discharge of its product contents, but which will not create high stress areas which could promote splitting of the bag's wall. The angle selected can also provide a way in which to control the product capacity of the bag. Within such considerations, it has been found that the described angle, shown more clearly in FIG. 3 as angle "A," should be at least about 5°, and a range from about 5° to about 30° has been found to be particularly compatible with the objectives described, such range therefore being preferred.

Figure 3:
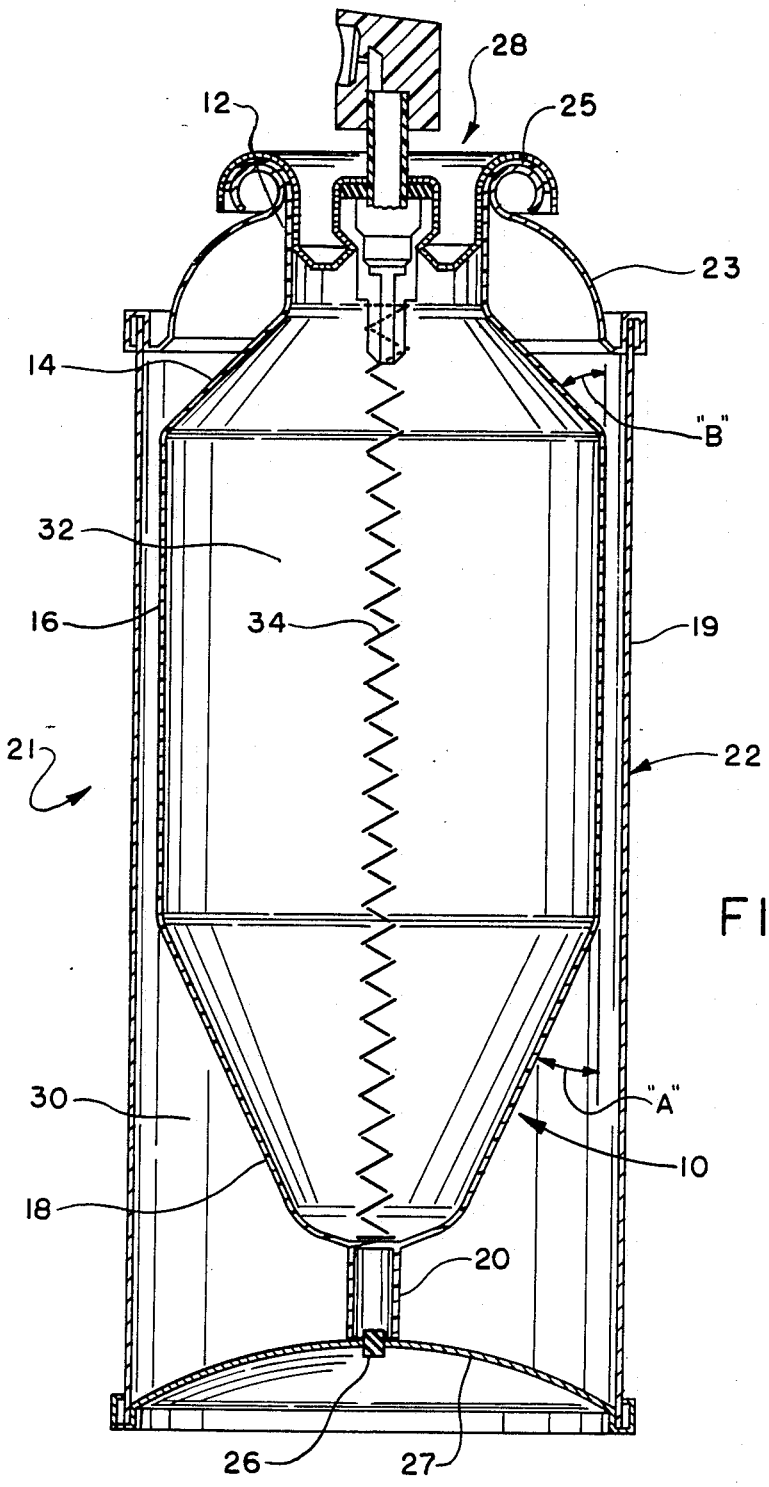
FIG. 3 is a cross-sectional view of a barrier pack can containing the product bag of FIG. 1, taken through the longitudinal center of the can.

The counterpart angle "B" of the frustum-shaped upper section 14, also more clearly shown in FIG. 3, may likewise be varied within a broad range, and many of the considerations determining selection of the angle of the lower frustum-shaped section 18 also supply with respect to the upper section 14. In addition, the angle "B" chosen will be such that the frustum-shaped section is structurally compatible with the concave shape of the barrier pack can's top into which it is positioned. Again, within such considerations, it has been found that angle "B" will normally be from about 30° to about 60°, although other angles are sometimes employed, depending upon the circumstances.

The provision of a foot 20 provides significant additional advantages to the bag of the invention, since it holds the bag steady, preventing it from tilting during filling to an orientation that might promote the entrapment of air bubbles within the bag. Furthermore, the foot serves as a support for the bag while the hollow open-ended cylindrical cap section 12 is flared over the opening in the top of the can adapted to receive the discharge valve.

The foot 20 constitutes a projection that may be cylindrical, square, or have some other cross-sectional shape, and that is at least partially open on its bottom portion. The open aspect of the foot is ordinarily provided to accommodate the needle inserted in the bottom of the can for introduction of the pressurizing propellant. When the can is thus filled with propellant, the normal pressurizing procedure, the presence of the foot also serves as a guard, preventing penetration of the bag by the filling needle.

Figure 2:
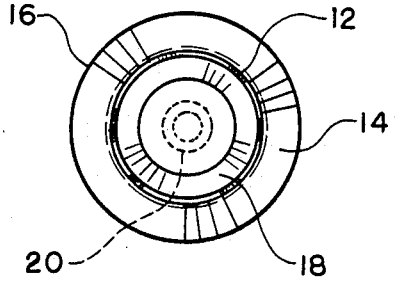
FIG. 2 is a top plan view of the product bag of FIG. 1.

FIG. 2 is a top plan view of the product bag of FIG. 1 showing the cylindrical cap section 12 adjoining the upper frustum-shaped section 14. Also visible are the outlines of the lower frustum-shaped section 18 attached to the lower end of the middle cylindrically shaped section 16. Foot 20 is illustrated at the center of the Figure, attached to the lower end of frustum-shaped section 18.

When the bag of the invention is to be employed in applications where contact of the propellant with the product to be discharged must be scrupulously avoided, it is desirable to employ substantially impermeable materials for fabricating the bag. While metallic materials such as aluminum foils, or others, can be used, they are not as desirable as plastics, since among other advantages, the latter can be inexpensively fabricated, for example, by the molding techniques previously referred to.

Desirably, such plastics will have a propellant permeability per 100 square inches of a film made therefrom of no more than about 0.015 cubic centimeters per mil, over a twenty-four hour period at atmospheric pressure. A more preferred value is about 0.001 cubic centimeters per mil under the same test conditions.

Where the plastic used must exhibit low permeability values, the selection will typically be made from materials such as, for instance, polyesters; high density polyolefins, including high density polyethylene; nylon 6; blends of polyacrylonitrile with methacrylate resins, polycarbonate resins, and equivalent materials. In those cases where admixing of the propellant with the product is of no consequence, any of a broad variety of plastics may be employed; however, in selecting an appropriate bag plastic, care must always be exercised to avoid the use of a material which is interactive with the product with which the bag is to be filled. For example, inasmuch as nylon 6 contains some water, its use with a urethane product is to be avoided since water and urethane compounds are interactive.

The bags of the invention lend themselves to dispensing a variety of products, including, but not limited to viscous products such as greases, room temperature vulcanizable silicones, adhesives, body seam sealers, urethanes, windshield sealants, and others. However, the bags may can also be used to dispense non-viscous products.

FIG. 3 is a cross-sectional view of a barrier pack can containing the product bag of FIG. 1, taken through the longitudinal center of the can.

The Figure illustrates a barrier pack can, generally 21, which includes a product bag 10 enclosed on the inside of a pressure can, generally 22. The can 22 is comprised of a can body 19, to which are attached a can bottom 27 and a can top 23, the latter having a discharge valve assembly, generally 28, attached thereto.

The product bag 10 includes a cylindrically-shaped middle section 16 with upper and lower frustum-shaped sections, respectively 14 and 18, adjoined thereto, the components forming a unitary hollow receptacle. A foot member 20 is located on the closed lower end of section 18, adjacent a filler plug 26. At the other, top end of the bag, an open-ended, cylindrically-shaped cap section 12 adjoins the upper end of section 14, attached to the pressure can 22 by being flared over can top 23 at 25. A product vent spacer 34 may be positioned inside the product bag 10 to avoid entrapment of product in the lower regions of the bag during its collapse, thereby assuring that substantially all of the product within the bag is accessible to the valve assembly 28 during the discharge process.

The barrier pack can is prepared by inserting the product bag 10 in a can body 19 to which a can bottom 27, preferably concave inwardly, has been attached. A can top 23 with an opening in the center thereof is thereafter placed over the cap section 12 of the bag and attached to the can body 19. Next, the top of the cap section 12 is flared over the opening in the can top 23, and the can is filled with product. An aerosol valve assembly is then crimped over the opening in the top of the can to which the bag's cap section has been previously fastened. Finally, pressurizing propellant is inserted into the space 30 between the product bag 10 and the pressure can 22 by means of a needle inserted through an elastometric filler plug 26 positioned in a hole in the bottom of the can. Alternatively, the propellant can be introduced through the hole in the bottom of the can and a filler plug inserted afterward. Propellant of a type and in an amount sufficient to produce a pressure of from about 30 to about 130 psig will normally be employed; although when a liquidified propellant is introduced, the pressure within the pressure can 22 will usually be from about 30 to about 70 psig at 70° F., (21.1° C.).

The dimensions of the barrier pack can components will vary, depending upon the amount of product to be introduced into the product bag, as well as other factors; however, in the case of a barrier pack can designed to hold approximately 8 fluid ounces, the middle section 16 may have a diameter of about 50 millimeters, and could be about 108 millimeters long. In such case, the smaller end of the upper section 14 may have a diameter of about 26 millimeters and be about 16 millimeters long, while the smaller diameter of the lower section 18 can be about 22 millimeters and the section about 60 millimeters long. The frustrum angle "A" in the bag described will preferably be from about 10° to about 15°, while the angle "B," of the upper section 14 will preferably be from about 50° to about 60°. In such a barrier pack can, the cap section will be about 9 millimeters in length, while the foot section can comprise a hollow, cylindrical, tubular projection about 20 millimeters long and about 12 millimeters in diameter. The thickness of the wall section of the bag described will be about 8–12 mils; however, such thickness will depend upon the nature of the plastic, the pressures involved, and similar factors.

As previously indicated, the product vent spacer 34 may be inserted to prevent the entrapment of product within the product bag during the latter's collapse. A spacer in the form of an elongated spring is suitable for the purpose; however, solid spacer profiles such as, for example, ones having an "X," a "U," a "V," or other equivalent transverse cross-sectional shape may also be employed for the purpose.

Barrier packs such as those described, are particularly suited to the pressurized discharge of product from pressurized cans, and in fact, it has been estimated that a barrier pack can containing a product bag capable of holding eight fluid ounces is approximately equivalent to a mechanically operated "caulking-gun," cartridge-type dispenser having a product capacity of about 10.2 fluid ounces, due to the fact that less waste is entailed in operation of the barrier pack can since no product is wasted in "drips" formed at the conclusion of the discharge cycle. In addition, since the discharge valve of the barrier pack can involves a positive cut-off at the end of a discharge sequence, the product is prevented from undergoing a device-disabling hardening, or other passage-blocking deterioration downstream of the discharge point.

While in accordance with the patent statutes a preferred embodiment and best mode has been presented, the scope of the invention is not limited thereto, but rather is measured by the scope of the attached claims.

What is claimed is:

1. A unitary collapsible product bag for storing product in a barrier pack product-dispensing can comprising:

an upper section;

a middle section; and a lower section, said middle section having an open-ended cylindrical shape, while said upper and lower sections are frustrum-shaped, the upper section being open-ended, and the lower section having an open larger end and a closed smaller end, the larger ends of said upper and lower sections adjoining respective ends of said middle section, wherein connection means are provided at the smaller end of said upper section for attaching said bag to the top of said can, interior thereof, while bag support means are attached to the smaller, closed end of said lower section for supporting said bag on the bottom of said can, and said bag support means comprising a tubular projection extending downward from the smaller end of said lower section, for positioning around a plug located in the can's bottom wall.

2. A product bag as defined in claim 1 wherein said connection means comprises a hollow, open-ended cylinder, one end of which adjoins the smaller end of said upper section, while the other end of which is adapted for attachment to the top of said can by being flared over an opening in the top of said can adapted to receive a dispensing valve.

3. A product bag according to claim 1 wherein said bag is fabricated from a relatively gas-impermeable plastic film.

4. A product bag according to claim 1 wherein the angle defined by the frustum wall along the longitudinal axis of said lower section, and a plane parallel to said axis, is from about 5° to about 30°.

5. A product bag according to claim 4 wherein said angle is from about 10° to about 15°.

6. A product-dispensing barrier pack can comprising:

a unitary collapsible bag;

a can;

a discharge valve;

a product to be dispense; and a propellant, wherein said bag, which is disposed inside said can, comprises an upper section, a middle section, and a lower section, said middle section having an open-ended cylindrical shape, while said upper and lower sections are frustum-shaped, the upper section being open-ended, and the lower section having an open larger end and a closed smaller end, the larger ends of said upper and lower sections adjoining respective ends of said middle section, wherein connections means are provided at the smaller end of said upper section for attaching said bag to the top of said can, interior thereof, while bag support means are attached to the smaller, closed end of said lower section for supporting said bag on the bottom of said can;

said can being enclosed except for an opening in the top thereof adapted to receive said discharged valve which is connected thereto, said bag being disposed inside said can with the interior of said bag in communication with said valve, and when said valve is opened, through said valve to the atmosphere outside said can, said bag being filled with said product to be dispensed and said propellant is inserted through an inlet plug in essentially the center of the bottom of said can and said propellant being located in the space between said can the said bag, and said bag means further comprising a tubular projection extending downward from the smaller end of said lower section and extending around the inlet plug of the can.

7. A product-dispensing barrier pack can according to claim 6 wherein the angle defined by the frustum wall along the longitudinal axis of said lower section, and a plane parallel to said axis, is from about 5° to about 30°.

8. A product-dispensing barrier pack can according to claim 7 wherein said angle is from about 10° to about 15°.

9. A product-dispensing barrier pack can according to claim 6 wherein said tubular projection has one open end and is seated directly over and circumscribing said inlet plug.

10. A product-dispensing barrier pack can according to claim 6 wherein said can further comprises a product vent spacer, said spacer running approximately longitudinally from the upper section of said bag to the lower section of said bag.

11. A product-dispensing barrier pack can comprising:

a unitary collapsible bag;

a can;

a discharge valve;

a product to be dispensed; and a propellant, wherein said bag, which is disposed inside said can, comprise an upper section, a middle section, and a lower section, said middle section having an open-ended cylindrical shape, while said upper and lower sections are frustum-shaped, the upper section being open-ended, and the lower section having an open larger end and a closed smaller end, the larger ends of said upper and lower sections adjoining respective ends of said middle section, and wherein said can is enclosed except for an opening in the top thereof adapted to receive said discharge valve which is connected thereto, said upper section also being connected to said opening by means of an open-ended hollow cylinder one end of which adjoins the smaller end of said upper section, while the other end of which is attached to said opening, the interior of said bag thereby being in communication with the atmosphere outside said can when said valve is open, and wherein further, said bag has a tubular projection attached thereto at the smaller end of said lower section, said projection extending from said lower section to the bottom of said can and extending around a plug in the bottom of the can.

12. A barrier pack can according to claim 11 wherein said can is steel, and said bag is fabricated from a relatively gas impermeable plastic.

13. A product-dispensing barrier pack can according to claim 11 wherein the angle defined by the frustum wall along the longitudinal axis of said lower section, and a plane parallel to said axis is from about 5° to about 30°.

14. A product-dispensing barrier pack can according to claim 13 wherein said angle is from about 10° to about 15°.

15. A product-dispensing barrier pack can according to claim 11 wherein said can further comprises a product vent spacer, said spacer running approximately longitudinally from the upper section of said bag to the lower section of said bag.

* * * * *